US007462767B1

(12) United States Patent
Swift

(10) Patent No.: US 7,462,767 B1
(45) Date of Patent: Dec. 9, 2008

(54) STRINGED MUSICAL INSTRUMENT TENSION BALANCER

(76) Inventor: Dana B. Swift, 1918 E. 36th St., Tulsa, OK (US) 74105

( * ) Notice: Subject to any disclaimer, the term of this patent is extended or adjusted under 35 U.S.C. 154(b) by 327 days.

(21) Appl. No.: 11/276,998

(22) Filed: Mar. 20, 2006

Related U.S. Application Data

(60) Provisional application No. 60/595,160, filed on Jun. 10, 2005.

(51) Int. Cl.
*G10D 3/00* (2006.01)
*G10D 1/00* (2006.01)
*G10D 1/08* (2006.01)

(52) U.S. Cl. ..... 84/291; 84/173; 84/295; 84/297 R; 84/297 S

(58) Field of Classification Search ..... 84/267–272, 84/284, 291, 294–302, 307–309, 313, 327, 84/329, 410
See application file for complete search history.

(56) References Cited

U.S. PATENT DOCUMENTS

| | | | | | |
|---|---|---|---|---|---|
| 3,686,993 | A | * | 8/1972 | Fender | 84/312 R |
| 3,853,031 | A | * | 12/1974 | DeWitt et al. | 84/267 |
| 3,933,077 | A | | 1/1976 | Dunlop | 84/318 |
| 3,978,756 | A | | 9/1976 | Feldman | 84/470 |
| 4,006,657 | A | | 2/1977 | Dunnette | 84/314 |
| 4,026,181 | A | * | 5/1977 | Barcus et al. | 84/291 |
| 4,026,182 | A | | 5/1977 | Gilbrech | 84/305 |
| 4,031,801 | A | | 6/1977 | Cecchini | 84/465 |
| 4,037,510 | A | | 7/1977 | Ginex et al. | 84/453 |
| 4,038,897 | A | | 8/1977 | Murray et al. | 84/1.16 |
| 4,061,069 | A | | 12/1977 | Brackett | 84/315 |
| 4,068,553 | A | | 1/1978 | Dopyera | 84/296 |
| 4,079,654 | A | | 3/1978 | Kasha | 84/291 |
| 4,084,476 | A | | 4/1978 | Rickard | 84/293 |
| 4,104,947 | A | | 8/1978 | Oster | 84/318 |
| 4,106,387 | A | | 8/1978 | Alifano | 84/312 |
| 4,112,804 | A | | 9/1978 | Cecchini | 84/173 |
| 4,126,072 | A | | 11/1978 | Taylor | 84/173 |
| 4,135,426 | A | | 1/1979 | Rickard | 84/1.16 |
| 4,137,813 | A | | 2/1979 | Stone et al. | 84/314 |
| 4,145,948 | A | | 3/1979 | Turner | 84/293 |
| 4,151,778 | A | | 5/1979 | Beattie et al. | 84/306 |
| 4,165,670 | A | | 8/1979 | Cahn | 84/318 |
| 4,170,917 | A | | 10/1979 | Wheelock | 84/319 |
| 4,172,404 | A | | 10/1979 | Dopyera | 84/291 |
| 4,173,168 | A | | 11/1979 | Hicks et al. | 84/470 |
| 4,183,279 | A | | 1/1980 | Shabram, Jr. | 84/318 |
| 4,200,023 | A | | 4/1980 | Kaman | 84/293 |
| 4,203,342 | A | | 5/1980 | Montgomery et al. | 84/293 |
| 4,205,583 | A | | 6/1980 | Absmann | 84/433 |

(Continued)

OTHER PUBLICATIONS

US 5,883,316, 03/1999, Kolano (withdrawn)

*Primary Examiner*—Jeffrey Donels
*Assistant Examiner*—Christopher Uhlir
(74) *Attorney, Agent, or Firm*—Head, Johnson & Kachigian

(57) ABSTRACT

A device and method for balancing the torque created by strings on musical instruments includes a bracket attached to the bottom of the bridge, an adjustable brace attached to the neck and residing within the body of the instrument and a tension string connecting the bracket and brace such than it offsets torques created by the strings that create the music. The device counteracts the tension created by guitar strings and provides enhanced vibration of the instrument sound-board.

2 Claims, 5 Drawing Sheets

U.S. PATENT DOCUMENTS

| | | | | |
|---|---|---|---|---|
| 4,206,678 | A | 6/1980 | Espinos Guerrero | 84/267 |
| 4,212,221 | A | 7/1980 | Woron | 84/1.26 |
| 4,221,151 | A | 9/1980 | Barth | 84/314 |
| 4,222,303 | A | 9/1980 | Kryzanowsky | 84/315 |
| 4,249,450 | A | 2/1981 | Quemore, Sr. | 84/317 |
| 4,253,371 | A | 3/1981 | Guice | 84/267 |
| 4,257,306 | A | 3/1981 | Laflamme | 84/485 |
| 4,287,806 | A | 9/1981 | Neary | 84/458 |
| 4,291,606 | A | 9/1981 | Lepage | 84/291 |
| 4,295,403 | A | 10/1981 | Harris | 84/293 |
| 4,297,936 | A | 11/1981 | Mouton | 84/314 |
| 4,306,480 | A | 12/1981 | Eventoff et al. | 84/1.01 |
| 4,307,646 | A | 12/1981 | Smith | 84/173 |
| 4,319,512 | A | 3/1982 | Clyburn | 84/318 |
| 4,331,059 | A | 5/1982 | Marabotto | 84/317 |
| 4,334,455 | A | 6/1982 | Beecher | 84/302 |
| 4,335,642 | A | 6/1982 | Pogoda | 84/454 |
| 4,338,847 | A | 7/1982 | Brennan | 84/20 |
| 4,348,934 | A | 9/1982 | Ogata | 84/306 |
| 4,364,298 | A | 12/1982 | Piazza | 84/465 |
| 4,366,740 | A | 1/1983 | Tripp | 84/298 |
| 4,375,180 | A | 3/1983 | Scholz | 84/454 |
| 4,377,101 | A | 3/1983 | Santucci | 84/1.16 |
| 4,378,722 | A | 4/1983 | Isakson | 84/1.15 |
| 4,378,723 | A | 4/1983 | Scholz | 84/297 |
| 4,383,464 | A | 5/1983 | Brennan | 84/21 |
| 4,397,212 | A | 8/1983 | Carson | 84/313 |
| 4,408,513 | A | 10/1983 | Clevinger | 84/1.15 |
| 4,411,186 | A | 10/1983 | Faivre | 84/291 |
| 4,412,473 | A | 11/1983 | Laflamme | 84/485 |
| 4,426,907 | A | 1/1984 | Scholz | 84/454 |
| 4,450,748 | A | 5/1984 | Shaw et al. | 84/291 |
| 4,468,997 | A | 9/1984 | Young, Jr. | 84/1.01 |
| 4,497,236 | A | 2/1985 | Rose | 84/298 |
| 4,498,366 | A | 2/1985 | Carr | 84/304 |
| 4,499,809 | A | 2/1985 | Clevinger | 84/1.15 |
| 4,503,748 | A | 3/1985 | Barber, Jr. | 84/474 |
| 4,505,178 | A | 3/1985 | Redman | 84/465 |
| 4,506,584 | A | 3/1985 | Oakley | 84/293 |
| 4,506,585 | A | 3/1985 | Desmond | 84/298 |
| 4,508,003 | A | 4/1985 | Smakula | 84/293 |
| 4,528,887 | A | 7/1985 | Frederick | 84/306 |
| 4,530,268 | A | 7/1985 | Starrett | 84/1.16 |
| 4,545,282 | A | 10/1985 | Arnett et al. | 84/317 |
| 4,549,461 | A | 10/1985 | Rose | 84/313 |
| 4,559,861 | A | 12/1985 | Patty et al. | 84/470 |
| 4,562,766 | A | 1/1986 | Scholz | 84/297 |
| 4,567,805 | A | 2/1986 | Clevinger | 84/1.16 |
| 4,572,050 | A | 2/1986 | Werner | 84/385 |
| 4,583,440 | A | 4/1986 | Powell, Jr. | 84/318 |
| 4,603,567 | A | 8/1986 | Smith et al. | 72/8 |
| 4,616,550 | A | 10/1986 | Lacroix et al. | 84/173 |
| 4,620,470 | A | 11/1986 | Vogt | 84/314 |
| 4,621,558 | A | 11/1986 | Cornette | 84/318 |
| 4,625,613 | A | 12/1986 | Steinberger | 84/298 |
| 4,630,520 | A | 12/1986 | Bonanno | 84/1.16 |
| 4,632,005 | A | 12/1986 | Steinberger | 84/313 |
| 4,635,518 | A | 1/1987 | Meno | 84/1.16 |
| 4,644,649 | A | 2/1987 | Seaman et al. | 30/229 |
| 4,658,690 | A | 4/1987 | Aitken et al. | 84/1.14 |
| 4,665,789 | A | 5/1987 | Papadatos | 84/317 |
| 4,672,877 | A | 6/1987 | Hoshino et al. | 84/299 |
| 4,674,387 | A | 6/1987 | Caruth | 84/304 |
| 4,674,388 | A | 6/1987 | Mathias | 84/312 |
| 4,679,481 | A | 7/1987 | Lozon | 84/309 |
| 4,697,492 | A | 10/1987 | Freed | 84/1.16 |
| 4,702,141 | A | 10/1987 | Bonanno | 84/1.16 |
| 4,704,935 | A | 11/1987 | Franklin | 84/312 |
| 4,712,464 | A | 12/1987 | Nance | 84/485 |
| 4,722,260 | A | 2/1988 | Pigozzi | 84/314 |
| 4,723,468 | A | 2/1988 | Takabayashi et al. | 84/1.16 |
| 4,726,275 | A | 2/1988 | Aitken et al. | 84/1.15 |
| 4,748,887 | A | 6/1988 | Marshall | 84/1.15 |
| 4,748,890 | A | 6/1988 | Tutaj | 84/485 |
| 4,750,397 | A | 6/1988 | Ashworth-Jones | 84/1.16 |
| 4,760,767 | A | 8/1988 | Tsurubuchi | 84/1.16 |
| 4,777,858 | A | 10/1988 | Petschulat et al. | 84/314 |
| 4,782,732 | A | 11/1988 | Kato et al. | 84/313 |
| 4,791,848 | A | 12/1988 | Blum, Jr. | 84/453 |
| 4,793,233 | A | 12/1988 | Olthoff | 84/299 |
| 4,796,506 | A | 1/1989 | Gray | 84/317 |
| 4,807,509 | A | 2/1989 | Graham | 84/314 |
| 4,821,924 | A | 4/1989 | Kozam | 222/211 |
| 4,846,038 | A | 7/1989 | Turner | 84/293 |
| 4,852,450 | A | 8/1989 | Novak | 84/314 |
| 4,872,388 | A | 10/1989 | Gunn | 84/297 |
| 4,882,967 | A | 11/1989 | Rose | 84/313 |
| 4,887,506 | A | 12/1989 | Freed | 84/727 |
| 4,888,112 | A | 12/1989 | Kronwald | 210/198.2 |
| 4,901,618 | A | 2/1990 | Blum, Jr. | 84/253 |
| 4,903,566 | A | 2/1990 | McClish | 84/734 |
| 4,907,483 | A | 3/1990 | Rose et al. | 84/726 |
| 4,909,122 | A | 3/1990 | Franke et al. | 84/329 |
| 4,915,009 | A | 4/1990 | Kunstadt | 84/743 |
| 4,930,389 | A * | 6/1990 | Kunstadt | 84/293 |
| 4,951,543 | A | 8/1990 | Cipriani | 84/298 |
| 4,953,435 | A | 9/1990 | Chapman | 84/293 |
| 4,953,439 | A | 9/1990 | Newell | 84/655 |
| 4,981,064 | A | 1/1991 | Vogt | 84/314 |
| 4,984,493 | A | 1/1991 | Schaller | 84/313 |
| 4,986,157 | A | 1/1991 | Matsubara | 84/646 |
| 4,993,300 | A | 2/1991 | Ejen | 84/314 |
| 5,016,514 | A | 5/1991 | Kaufman | 84/318 |
| 5,019,745 | A | 5/1991 | Deal et al. | 313/440 |
| 5,025,695 | A | 6/1991 | Viel | 84/293 |
| 5,025,696 | A | 6/1991 | Brown | 84/314 |
| 5,029,507 | A | 7/1991 | Bezeau, Jr. | 84/485 |
| 5,033,351 | A | 7/1991 | Nomura | 84/646 |
| 5,038,656 | A | 8/1991 | Anderson | 84/380 |
| 5,052,260 | A | 10/1991 | Cipriani | 84/298 |
| 5,065,659 | A | 11/1991 | Uchiyama et al. | 84/723 |
| 5,072,563 | A | 12/1991 | Menegoli | 52/537 |
| 5,072,643 | A | 12/1991 | Murata | 84/293 |
| 5,078,037 | A | 1/1992 | Sutcliffe et al. | 84/291 |
| 5,085,115 | A | 2/1992 | Schlink | 84/310 |
| 5,103,708 | A | 4/1992 | Steinberger | 84/304 |
| 5,113,737 | A | 5/1992 | Gregory | 84/267 |
| 5,123,324 | A | 6/1992 | Rose et al. | 84/726 |
| 5,125,312 | A | 6/1992 | Fishman et al. | 84/291 |
| 5,127,299 | A | 7/1992 | Stroh et al. | 84/314 |
| 5,133,239 | A | 7/1992 | Thomas | 84/314 |
| 5,140,887 | A | 8/1992 | Chapman | 84/646 |
| 5,153,363 | A | 10/1992 | Fishman et al. | 84/731 |
| 5,153,364 | A | 10/1992 | Uchiyama et al. | 84/742 |
| 5,162,603 | A | 11/1992 | Bunker | 84/737 |
| 5,175,387 | A | 12/1992 | Greory | 84/267 |
| 5,189,235 | A | 2/1993 | Fishman et al. | 84/291 |
| 5,218,159 | A | 6/1993 | McClish | 84/731 |
| 5,233,123 | A | 8/1993 | Rose et al. | 84/726 |
| 5,260,505 | A | 11/1993 | Kendall | 84/298 |
| 5,260,511 | A | 11/1993 | Gregory | 84/740 |
| 5,305,674 | A | 4/1994 | Fishman et al. | 84/291 |
| 5,315,058 | A | 5/1994 | Okamoto et al. | 84/626 |
| 5,323,676 | A | 6/1994 | Kennedy | 84/317 |
| 5,325,757 | A | 7/1994 | Ghenea | 84/314 |
| 5,337,644 | A | 8/1994 | Fishman et al. | 84/314 |
| 5,339,718 | A * | 8/1994 | Leduc | 84/291 |
| 5,380,948 | A | 1/1995 | Freimuth et al. | 84/8 |
| 5,386,757 | A | 2/1995 | Derrick | 84/473 |
| 5,392,680 | A | 2/1995 | Stets | 84/313 |
| 5,394,775 | A | 3/1995 | Fagerstrom | 81/479 |
| 5,401,900 | A | 3/1995 | Lace | 84/743 |
| 5,404,783 | A | 4/1995 | Feiten et al. | 84/298 |
| 5,438,157 | A | 8/1995 | Lace, Sr. et al. | 84/726 |

| | | | | | |
|---|---|---|---|---|---|
| 5,438,158 | A | | 8/1995 | Riboloff | 84/727 |
| 5,442,986 | A | | 8/1995 | Cota | 84/267 |
| 5,448,008 | A | | 9/1995 | Okamoto et al. | 84/658 |
| 5,507,213 | A | | 4/1996 | Beseke | 84/280 |
| 5,520,082 | A | | 5/1996 | Armstrong et al. | 84/313 |
| 5,537,906 | A | | 7/1996 | Steinberger | 84/291 |
| 5,542,330 | A | | 8/1996 | Borisoff | 84/298 |
| 5,549,027 | A | | 8/1996 | Steinberger et al. | 84/297 |
| 5,553,720 | A | | 9/1996 | Dardashti | 211/40 |
| 5,560,499 | A | | 10/1996 | Dardashti | 211/40 |
| 5,567,894 | A | | 10/1996 | Shiomi | 84/291 |
| 5,572,791 | A | | 11/1996 | Kojima | 29/896.22 |
| 5,585,588 | A | | 12/1996 | Tumura | 84/726 |
| 5,594,191 | A | | 1/1997 | Epstein et al. | 84/485 |
| 5,600,079 | A | | 2/1997 | Feiten et al. | 84/312 |
| 5,631,432 | A | | 5/1997 | Muncy | 84/293 |
| 5,641,932 | A | | 6/1997 | Lace | 84/727 |
| 5,644,096 | A | | 7/1997 | Bull | 84/485 |
| 5,652,403 | A | | 7/1997 | Sugiyama et al. | 84/708 |
| 5,679,910 | A | * | 10/1997 | Steinberger et al. | 84/291 |
| 5,691,490 | A | | 11/1997 | Williams | 84/170 |
| 5,698,808 | A | | 12/1997 | Hamlin | 84/722 |
| 5,728,956 | A | | 3/1998 | Feiten et al. | 84/314 |
| 5,739,444 | A | * | 4/1998 | Borisoff | 84/291 |
| 5,747,713 | A | | 5/1998 | Clement | 84/313 |
| 5,756,914 | A | | 5/1998 | Streibl | 84/465 |
| 5,760,322 | A | | 6/1998 | Ward et al. | 89/314 |
| 5,804,746 | A | | 9/1998 | Kersenbrock et al. | 84/291 |
| 5,847,298 | A | | 12/1998 | Adams | 84/314 |
| 5,883,323 | A | | 3/1999 | Kaufman | 84/454 |
| 5,895,872 | A | | 4/1999 | Chase | 84/291 |
| 5,920,023 | A | | 7/1999 | Ravagni et al. | 84/485 |
| 5,925,839 | A | | 7/1999 | Schertler | 84/298 |
| 5,932,827 | A | | 8/1999 | Osborne et al. | 84/726 |
| 5,952,593 | A | | 9/1999 | Wilder | 84/314 |
| 5,965,831 | A | | 10/1999 | McCabe | 84/313 |
| 5,986,190 | A | | 11/1999 | Wolff et al. | 84/297 |
| 5,986,191 | A | | 11/1999 | McCabe | 84/313 |
| 5,990,396 | A | | 11/1999 | Lasner | 84/293 |
| 5,990,410 | A | | 11/1999 | Johnson | 84/731 |
| 5,995,335 | A | | 11/1999 | Jurgenson et al. | 360/109 |
| 6,013,868 | A | | 1/2000 | Sims et al. | 84/318 |
| 6,018,119 | A | | 1/2000 | Mladek | 84/722 |
| 6,018,120 | A | | 1/2000 | Steinberger | 84/731 |
| 6,034,310 | A | | 3/2000 | Kolano | 84/293 |
| 6,040,510 | A | | 3/2000 | Yaun | 84/294 |
| 6,069,306 | A | | 5/2000 | Isvan et al. | 84/267 |
| 6,072,151 | A | | 6/2000 | Jurgenson et al. | 219/121.85 |
| 6,080,925 | A | | 6/2000 | Rogers et al. | 84/485 |
| 6,084,166 | A | | 7/2000 | Lee | 84/313 |
| 6,087,622 | A | | 7/2000 | Summers | 219/121.64 |
| 6,100,459 | A | | 8/2000 | Yost | 84/313 |
| 6,107,556 | A | | 8/2000 | Gilliam | 84/454 |
| 6,111,175 | A | | 8/2000 | Lasner | 84/293 |
| 6,143,967 | A | | 11/2000 | Smith et al. | 84/313 |
| 6,156,962 | A | | 12/2000 | Poort | 84/314 |
| 6,166,307 | A | | 12/2000 | Caulkins et al. | 84/50 |
| 6,172,292 | B1 | | 1/2001 | Dimbath | 84/453 |
| 6,184,450 | B1 | | 2/2001 | LeBlanc | 84/307 |
| 6,191,346 | B1 | | 2/2001 | Swan | 84/307 |
| 6,191,350 | B1 | | 2/2001 | Okulov et al. | 84/646 |
| 6,225,539 | B1 | | 5/2001 | Freeman | 84/322 |
| 6,252,149 | B1 | | 6/2001 | Matsushita | 84/314 |
| 6,278,047 | B1 | | 8/2001 | Cumberland | 84/455 |
| 6,348,646 | B1 | | 2/2002 | Parker et al. | 84/297 |
| 6,350,940 | B1 | | 2/2002 | Upchurch et al. | 84/314 |
| 6,372,971 | B1 | | 4/2002 | Rogers | 84/298 |
| 6,426,454 | B1 | | 7/2002 | Gregory | 84/267 |
| 6,441,281 | B1 | | 8/2002 | Rattner et al. | 84/298 |
| 6,441,293 | B1 | | 8/2002 | LaBarbera | 84/723 |
| 6,448,488 | B1 | | 9/2002 | Exhaus et al. | 84/735 |
| 6,468,106 | B2 | | 10/2002 | Durocher | 439/493 |
| 6,478,487 | B1 | | 11/2002 | Jou et al. | 400/240 |
| 6,489,794 | B1 | | 12/2002 | Cram | 324/762 |
| 6,512,168 | B2 | | 1/2003 | Cortes | 84/290 |
| 6,515,207 | B1 | | 2/2003 | Gregory | 84/312 |
| 6,515,209 | B2 | | 2/2003 | Pittman | 84/453 |
| 6,534,697 | B1 | | 3/2003 | Ko | 84/299 |
| 6,538,183 | B2 | | 3/2003 | Verd | 84/291 |
| 6,563,032 | B2 | | 5/2003 | Gregory | 84/290 |
| 6,563,037 | B2 | | 5/2003 | Hamilton | 84/484 |
| 6,583,345 | B1 | | 6/2003 | Clinton | 84/291 |
| 6,603,066 | B2 | | 8/2003 | Rogers | 84/298 |
| 6,610,915 | B2 | | 8/2003 | Schleske | 84/291 |
| 6,627,802 | B1 | | 9/2003 | Jones | 84/290 |
| 6,627,808 | B1 | | 9/2003 | Coats et al. | 84/723 |
| 6,657,113 | B2 | | 12/2003 | Herman | 84/314 |
| 6,710,234 | B2 | | 3/2004 | Gregory | 84/312 |
| 6,723,904 | B1 | | 4/2004 | Dolan et al. | 84/267 |
| 6,730,839 | B2 | | 5/2004 | Itou | 84/719 |
| 6,741,091 | B2 | | 5/2004 | Cram | 324/762 |
| 6,750,385 | B1 | | 6/2004 | Sugden | 84/274 |
| 6,756,802 | B2 | | 6/2004 | Cram | 324/762 |
| 6,765,137 | B2 | | 7/2004 | Smart | 84/313 |
| 6,770,804 | B2 | | 8/2004 | Schleske | 84/290 |
| 6,774,292 | B2 | | 8/2004 | Mace | 84/293 |
| 6,777,601 | B1 | | 8/2004 | Kerfoot | 84/291 |
| 6,777,608 | B1 | | 8/2004 | Redding | 84/746 |
| 6,812,696 | B2 | | 11/2004 | Murphy | 324/260 |
| 6,891,094 | B2 | | 5/2005 | McCabe | 84/312 |

* cited by examiner

STRINGED MUSICAL INSTRUMENT TENSION BALANCER

CROSS-REFERENCE OF RELATED APPLICATION

This application claims priority to U.S. Provisional Application No. 60/595,160, filed Jun. 10, 2005.

BACKGROUND OF THE INVENTION

1. Field of the Invention

The present invention relates to a device and method for balancing the torques created by strings on stringed acoustical musical instruments. Specifically, the torque created by the strings on a musical instrument is countered by an opposite torque applied to the bridge through the neck of the instrument.

2. Prior Art

Acoustic guitars, dulcimers, basses, mandolins, and other similar stringed musical instruments are surprisingly quiet, considering their size. This is due primarily to the fact that the tension in the strings create a torque on the soundboard via the bridge due to the height of the strings above the soundboard that must be counteracted in some way to prevent the warping, or destruction, of the soundboard. Usually this is accomplished with stiff bracing under the soundboard which consequently limits its acoustic potential.

There are a variety of existing methods and devices designed to alleviate this torquing effect. Most of them consist of using some sort of brace that stiffens the soundboard such that is able to withstand the combination of tensions and torques. Alternately the strings can be run past the bridge to a tailpiece which limits the downforce coupling the vibrational energy in the string to the soundboard. Another method which is used is to create an apparatus in compression under the soundboard that creates an opposing torque at the expense of much added mass to the system limiting its acoustical response.

U.S. Pat. No. 5,260,505, Kenall, describes a device and system to counteract the torque created on the soundboard of a guitar using an internal compression brace extending to the tailblock of the instrument. While this in fact counteracts the torque it has the very undesirable effect of being relatively massive and consequently hindering the motion of the soundboard. Additionally this method applies additional forces to the distal end of the body of the instrument which must be carried back to the neck through other structures of the instrument.

The present invention has particular application to musical stringed instruments where the strings terminate in the bridge area as opposed to stringed instruments such as violins where the strings continue past the bridge.

It is, therefore, an object of the present invention to provide a method for balancing the tension of the strings on a musical instrument such that the soundboard of the instrument is allowed to move freely.

SUMMARY OF THE INVENTION

The present invention counter balances the torques created by the strings on the soundboard of musical instruments. It does so in such a manner as to allow the instrument to reverberate. By relieving this torque in a novel way provided in this disclosure, the increased motion allowed in the soundboard greatly increases the volume of sound emitted from the instrument. Those skilled in the art will appreciate that this greatly increases the value of the instrument.

In the present invention, the torque is counter balanced by use of an additional string or cable, preferably made of Kevlar, carbon fiber or a similar non-elastic material, that is attached to the bridge and the neck of the guitar within the body. Preferably, the tension of the string may be adjusted for optimal effect.

A bracket is located inside the body of the instrument and attached to the bottom of the bridge of the instrument. It is connected to an adjustable brace by a non-elastic string. The adjustable brace may adjust the tension placed upon the string to control the amount of counter-balancing tension. By adjusting this tension, the sound of the instrument and flatness of its soundboard may be adjusted. The adjustable brace is attached to the bottom of the neck of the instrument inside the body. This effect is optimal when the combined forces from the strings and the added tension cable are in line with the material of the soundboard. This design renders the traditional torque bracing unnecessary and undesirable, tone bracing of the soundborad may still be desired for creating or reducing specific resonances for musical purposes. This removed or much lighter bracing, in turn, allows soundboard to carry stronger vibrations, causing the overall volume and tonal response of the instrument to be increased. Other braces and designs, while reducing the torques on the soundboard caused by the strings acting on the bridge, use counter-balancing in the opposite direction of the present invention. It is this unusual approach that offers the superior quality provided in the present invention.

DETAILED DESCRIPTION OF THE PREFERRED EMBODIMENTS

Figure 1:
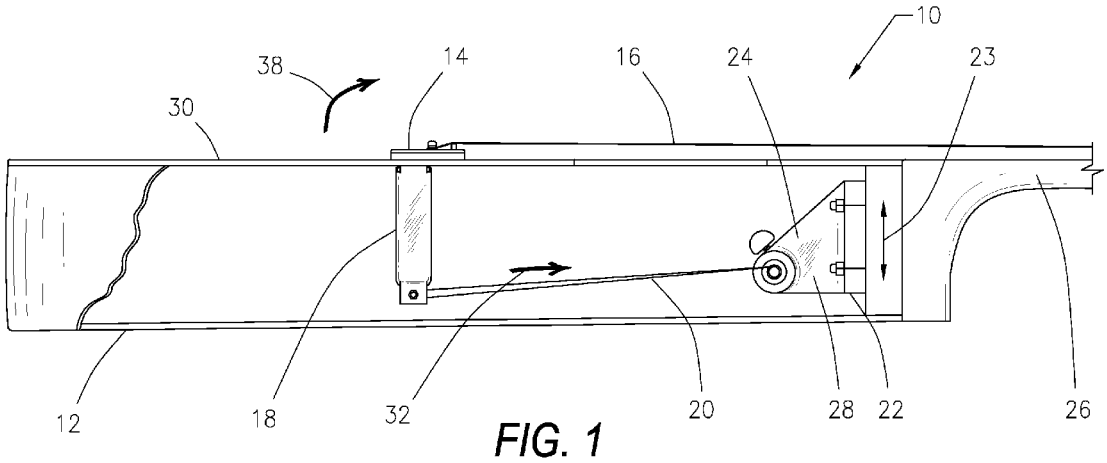
FIG. 1 is a side cut-away view of the present invention.

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

The present invention comprises a new method for reducing the torques created on the soundboard by the string tension acting on the bridge. The invention is a system for balancing the torques on the soundboard of musical instruments, such as guitars, mandolins, dulcimers and others, to prevent the deformation of the soundboard. The system employs an extremely low mass tension fiber to create an adjustable force operating on a low mass structure attached below the bridge. The tension in the fiber will automatically cancel out the torque moments generated by the strings. Therefore the soundboard is extremely free to vibrate allowing independent adjustment of the musical properties to the structural needs of the soundboard bracing for the instrument.

The invention causes an automatic balancing torque for the torque created by the strings of a musical instrument passing over the bridge saddle and terminating at a point below the bridge.

The invention consists of a structural member rigidly bound to the bridge of the instrument. In the shown embodiment the structural member is constructed from a lightweight aluminum alloy. The weight of this member adversely affects the performance of the musical instrument, so lightweight construction is preferred.

To supply the necessary tension to the structural member a cable is constructed from a low mass material. The shown embodiment uses Kevlar-49 roving to create the necessary tension cable with a sufficiently low mass, but those skilled in the art will appreciate that there are other suitable materials. High strength to mass allows the tension cable to create no musical resonance's in the instrument and therefore has no contribution to the musical properties of the soundboard. Any other fiber or combination of fiber types having similar properties such as carbon-carbon or monofilament nylon could be used as well.

Anchoring the tension cable to the neck heel block is done with a turnbuckle or other device to adjust the effective length of the tension cable.

The invention supplies the necessary structural components along with the tension carried through the soundboard to eliminate the need for conventional soundboard bracing. This results in tremendous musical advantages such as improved volume and bass response without sacrificing the treble response of the instrument.

Tuning the soundboard for the best musical aesthetics is possible without concern for the structural impacts. The aesthetics of the instrument are the unique pattern of bandpasses and resonance's created by the unique physical construction of the instrument. This invention decouples the structural aspects of the tone bracing from the aesthetic needs of the tonal bracing of the soundboard.

Referring to the Figures, guitar 10 has a hollow body 12 and a neck 26. Not shown is the head of the guitar at the end of the neck. Strings 16 extend from bridge 14 to the head, not shown. Strings 16 are under a great deal of tension. This tends to distort the top 30 of the body 12. Bridge 14 tends to pivot in the direction of arrow 32, due to the tension provided by the strings 16. This causes force upon the top 30 of the body 12 in the direction of arrow 38. Those skilled in the art will appreciate that this warps the body of the guitar. Tension also reduces the flexibility of the body 12, thereby reducing the amount by which it may reverberate and amplify the sound created by the strings 16. To relieve this tension, a bracket 18 is attached to the bottom of bridge 14 in the inside of guitar body 12. Bracket 18 is connected to adjustable brace 22 by means of non-elastic string 20. Brace 22 is adjustable in the directions of arrow 23. Preferably, string 20 is made of Kevlar, but this is not necessary. String 20 is attached to brace 22 at rotatable post 28. When knob 24 is twisted, it may loosen or tighten the tension of string 20. In this manner, the guitar may be adjusted so that the tension provided by string 20 is equal to the tension provided by string 16. Those skilled in the art will appreciate that when these tensions balance out, force applied to the body 12 in the direction of arrow 38 is eliminated. This allows the top 30 of body 12 to reverberate freely. This greatly increases the volume of the sound emitted from the guitar. Brace 22 is fixedly and securely attached to neck 26 so that the tension created by string 20 is carried through to the top of the neck at the head. Both bracket 18 and brace 22 are preferably made of a strong metal. However, those skilled in the art will appreciate that plastic or other suitably strong materials may be used.

Adjusting the tension of string 20, using knob 24, allows for subtle changes in the sound made by the instrument. Those skilled in the art will appreciate that this increases the usefulness of the instrument by allowing it to sound louder and more musical while maintaining the structural integrity, by setting the tension of string 20.

Figure 2:
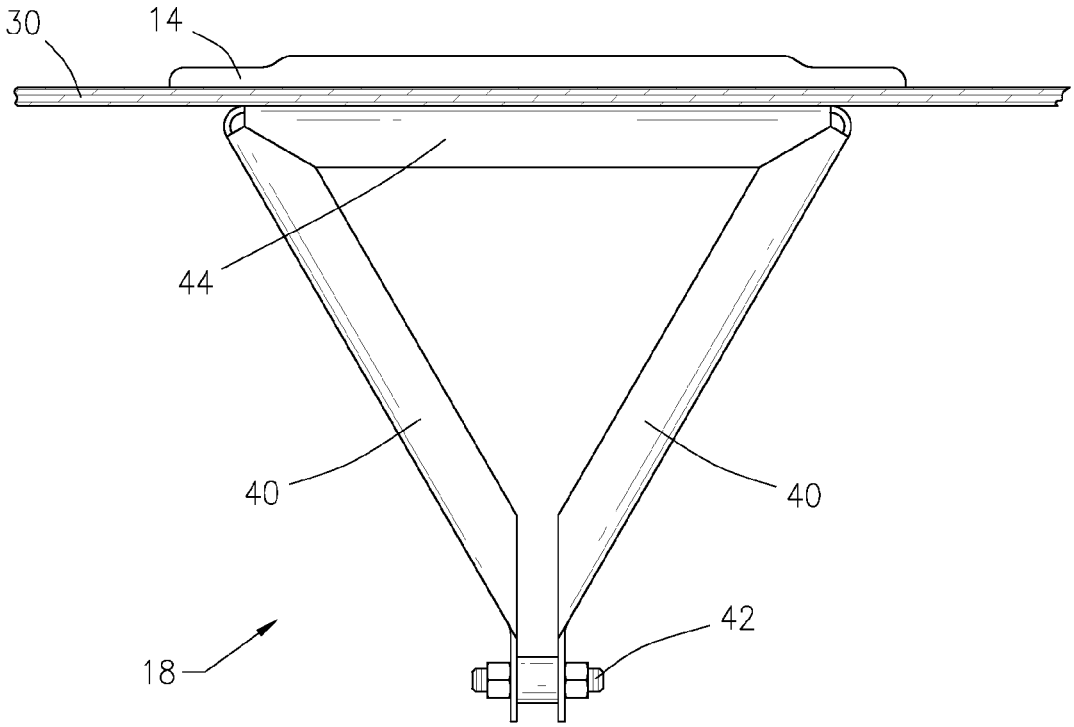
FIG. 2 is a front view of a bracket of the invention.

FIG. 2 shows a front view of the bracket 18. It is shown attached to the bridge 14. It may be attached by nuts and bolts or any other method known in the art which allows for the bridge to lie on the outside of the front of the guitar and for the bracket to be inside the body of the guitar and fixedly attached to the bridge.

Bracket 18 consists of a base 44 and two arms 40. Arms 40 are attached to opposite ends of base 44 and are connected to one another by pin 42. Pin 42 may be permanently or removably attached to arms 40 in any of the many methods known in the art. Pin 42 is attached to the counter-balancing string comprised of Kevlar or the like. Arms 40 and base 44 are preferably comprised of metal, but may also be plastic, carbon fiber or any sufficiently strong material known in the art.

Figure 3:
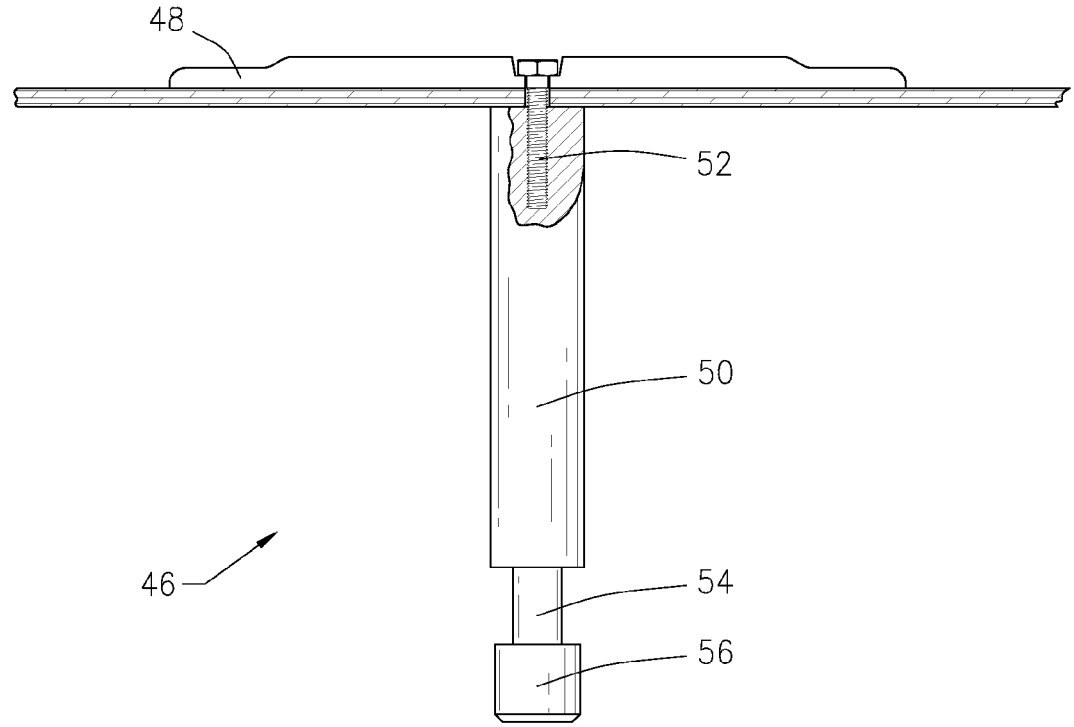
FIG. 3 is an alternative embodiment of the bracket of the invention.
Figure 4:
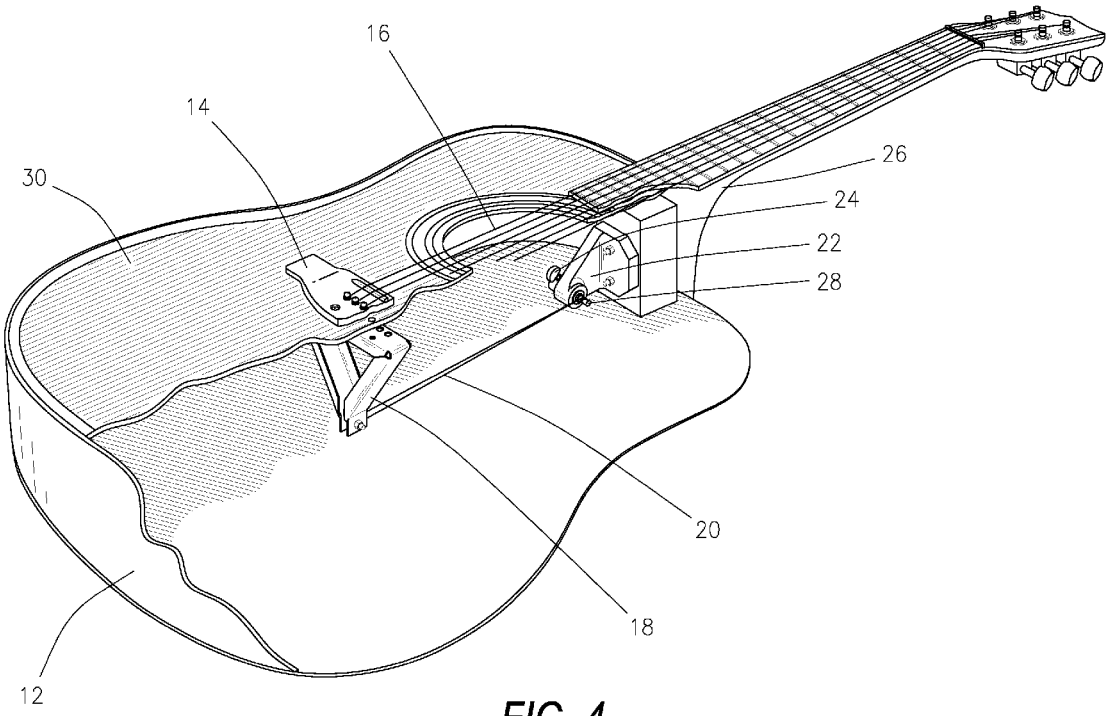
FIG. 4 is a cut-away perspective view of the invention.
Figure 5:
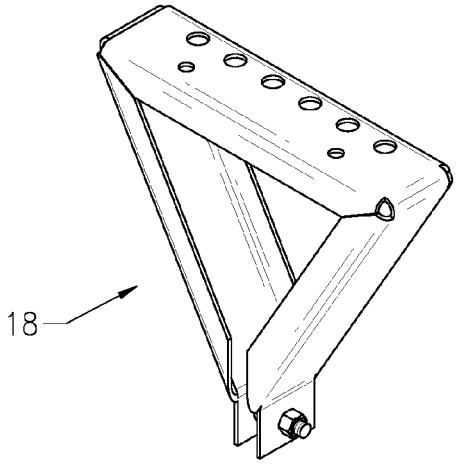
FIG. 5 is a perspective view of the bracket shown in FIG. 2 not attached to a bridge.
Figure 6:
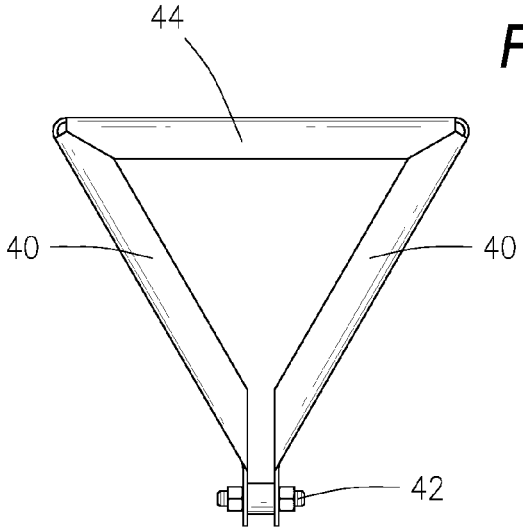
FIG. 6 is a front view of the bracket of FIG. 2 shown not attached to a bridge.
Figure 7:
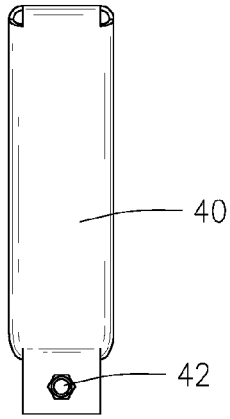
FIG. 7 is a side view of the bracket of FIG. 2 not attached to a bridge.
Figure 8:
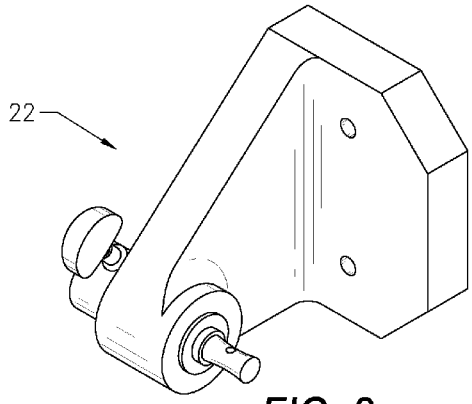
FIG. 8 is a perspective view of the brace.
Figure 9:
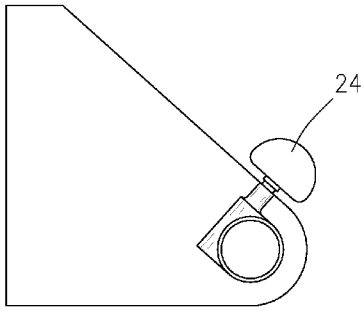
FIG. 9 is a side view of the brace.
Figure 10:
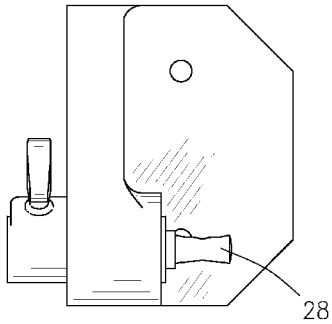
FIG. 10 is a front view of the brace.
Figure 11:
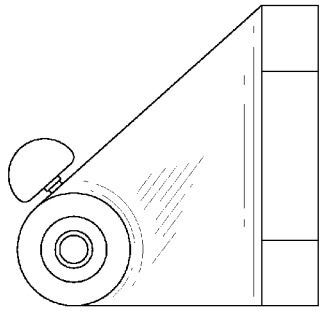
FIG. 11 is a side view of the brace.

FIG. 3 shows an alternative embodiment of the bracket 46. In this particular embodiment, bracket 46 screws on to a threaded post 52 that protrudes from the bottom of bridge 48. Bracket 46 consists of main body 50, a recessed attachment point 54 and end 56. Attachment point 54 is slightly recessed, having a smaller diameter than the rest of the bracket. In this particular embodiment, bracket 46 is cylindrical. However, those skilled in the art will appreciate that either cylindrical or various parallelepiped shapes are suitable for bracket 46. The counter-balancing string is attached to bracket 46 attachment point 54. As attachment point 54 is recessed, having a smaller radius and diameter than body 50 and end 56, the counter-balancing string is prevented from falling off the bracket. This design, as with that shown in FIG. 2, preferably has a bracket comprised of metal, preferably stainless steel or the like. However, those skilled in the art will appreciate that any suitably hard material is suitable.

The design shown in FIG. 2 and others similar to it is generally preferred because of base 44. Because base 44 expands most or all of the distance of the length of the bridge, multiple attachment points may be provided, therefore better distributing force in a single attachment point as shown in FIG. 3.

Whereas, the present invention has been described in relation to the drawings attached hereto, it should be understood that other and further modifications, apart from those shown or suggested herein, may be made within the spirit and scope of this invention.

What is claimed is:

1. A musical instrument string torque balancer for a musical stringed instrument having a hollow body with a freely vibrating top, a bridge, a neck, and strings, which balancer comprises:

a bracket located entirely within the hollow body of the instrument and fixedly attached to the freely vibrating top of the body beneath the bottom of the bridge such that said bracket is not directly connected to said strings of said instrument and prevents pivoting in direct response to the tensioning of said strings;

an adjustable brace fixedly attached to the neck of the instrument and residing within the hollow body of the instrument; and a counter-balance string comprised of non-elastic material fixedly attached to the bracket and adjustably attached to the adjustable brace such that the tension of the counter-balanced string may be adjusted, wherein the counter-balanced string creates torque approximately equal and opposite to the torque created by the musical strings used for making sound.

2. The string torque balancer of claim 1 wherein the bracket is comprised of a single body fixedly attached to the bridge and protruding downward, the body having a recessed string attachment point.

* * * * *